United States Patent [19]

Leonard et al.

[11] 4,288,210

[45] Sep. 8, 1981

[54] GAS COLLECTOR/IGNITER FOR GRILLS

[75] Inventors: Murray Leonard, Mayfield; Herbert F. Jugl, Bedford, both of Ohio

[73] Assignee: Vernitron Corporation, Lake Success, N.Y.

[21] Appl. No.: 58,391

[22] Filed: Jul. 17, 1979

Related U.S. Application Data

[63] Continuation-in-part of Ser. No. 941,281, Sep. 11, 1978, Pat. No. 4,226,930.

[51] Int. Cl.[3] ..... F23Q 7/06; H01T 13/20

[52] U.S. Cl. ..... 431/263; 431/191; 313/143

[58] Field of Search ..... 126/41 R, 25 A, 25 B, 126/39 E; 431/191, 192, 194, 263, 354, 264; 313/143, 145; 310/339; 361/260; 248/219.4, 218.4, 230

[56] References Cited

U.S. PATENT DOCUMENTS

| | | | |
|---|---|---|---|
| 1,354,617 | 10/1920 | Lange | 313/143 |
| 3,449,638 | 6/1969 | Beesch | 431/264 X |
| 3,494,583 | 2/1970 | Parr | 248/218.4 |
| 3,562,590 | 2/1971 | Mitts | 431/263 X |
| 3,592,179 | 7/1971 | Hahn | 126/41 R |
| 3,718,425 | 2/1973 | Weyl et al. | 431/263 X |
| 3,823,345 | 7/1974 | Mitts et al. | 431/263 X |
| 4,035,136 | 7/1977 | Howatt et al. | 431/263 X |
| 4,188,937 | 2/1980 | Baynes | 431/192 X |
| 4,206,492 | 6/1980 | Rhodes et al. | 431/263 X |

FOREIGN PATENT DOCUMENTS

| | | | |
|---|---|---|---|
| 526144 | 9/1940 | United Kingdom | 431/191 |
| 1022394 | 3/1966 | United Kingdom | 431/263 |

*Primary Examiner*—Samuel Scott
*Assistant Examiner*—Randall L. Green

[57] ABSTRACT

A spark igniter for gas grills includes a gas collector mountable on the grill housing adjacent a gas burner and having a collector inlet for receiving gas from the burner. An adjustable mounting device attached to the collector provides vertical adjustment of the collector for positioning the collector inlet at a proper elevation for receiving gas from the burner. The adjustable mounting device also serves to attach an electrode to the collector and position the electrode tip in a predetermined location for defining a spark gap.

9 Claims, 4 Drawing Figures

GAS COLLECTOR/IGNITER FOR GRILLS

This application is a continuation-in-part of copending application, Ser. No. 941,281, filed Sept. 11, 1978, now U.S. Pat. No. 4,266,930 issued May 12, 1981.

BACKGROUND OF THE INVENTION

The invention relates generally to igniters for gas burners and, more particularly, to arrangements for adjustably mounting such igniters adjacent a gas burner. The invention is particularly applicable for use with spark igniters on gas grills and will be particularly described with reference thereto. However, it will be appreciated that the improved mounted arrangement can be used on other igniters.

Gas grills for domestic use in cooking food include a dished housing having a housing base and a gas burner is mounted within the housing adjacent the base. A spark igniter is mounted to the housing base by a bracket. The position of the burner relative to the housing base varies from one grill manufacturer to another, and also varies with different models of the same manufacturer. Thus, a large number of different mounting brackets are required for properly locating the spark igniter relative to the burner. The difficulty with adjusting the position of the spark igniter in prior arrangements frequently results in a device which does not operate satisfactorily. Using a different bracket for each different make and model of grill is very expensive and still provides no final adjustment.

It is therefore the primary object of the present invention to provide a spark igniter with an adjustable mounting arrangement for properly locating same relative to a gas burner regardless of the make and model of the grill.

It is a further object of the invention to provide a spark igniter with an adjustable mounting device which also functions as the attachment and locator for an electrode forming part of a spark gap.

It is also an object of the invention to provide a spark igniter with an adjustable mounting arrangement which is very simple and economical to manufacture and assemble.

SUMMARY OF THE INVENTION

An aspect of the prsent invention resides in a spark igniter including a gas collector having a collector chamber defined between spaced top, bottom and side walls. A lateral inlet between the top and bottom walls provides gas flow into the collector chamber. Adjustable mounting means is provided on the collector for adjustably mounting same to the base of a grill housing to adjust the elevation of the collector inlet and position same at the desirable elevation relative to the gas ports on the gas burner.

In one arrangement, the adjustable mounting means includes a tube having one tube end portion secured to the bottom wall of the collector in alignment with a hole through the bottom wall. The tube has a free end opposite from the one end portion which is secured to the bottom wall of the gas collector. A ceramic sleeve is received in the tube and an electrode mounted in the sleeve has an electrode tip positioned within the gas collector chamber. An outwardly extending shoulder on the sleeve opposite from the electrode tip bears against the free end of the tube for properly locating the electrode tip within the gas collector chamber.

The gas collector is preferably constructed of sheet metal and the electrode tip is positioned in a predetermined spaced relationship to the top wall of the gas collector to define a spark gap. The tube is externally threaded and extends through a hole in the base of the grill housing. Nuts threaded on the tube on opposite sides of the housing base adjustably secure the tube to the housing base.

The one end portion of the tube preferably extends through the hole in the bottom wall of the gas collector until an outwardly extending shoulder on the tube bears against the outer surface of the collector bottom wall. The end portion of the tube is swaged over against the inside surface of the collector bottom wall opposite from the tube shoulder for securing the tube to the collector against relative longitudinal and rotational movement.

An end portion of the ceramic sleeve extends into the gas collector chamber. Fastener means securing the ceramic sleeve within the tube is in the form of a spring grip fastener gripping the end portion of the sleeve and bearing against the inner surface of the gas collector bottom wall for holding the sleeve shoulder against the free end of the tube.

For a better understanding of the present invention, together with other and further objects thereof, reference is had to the following description taken in connection with the accompanying drawings, and its scope will be pointed out in the appended claims.

DESCRIPTION OF THE PREFERRED EMBODIMENT

Figure 1:
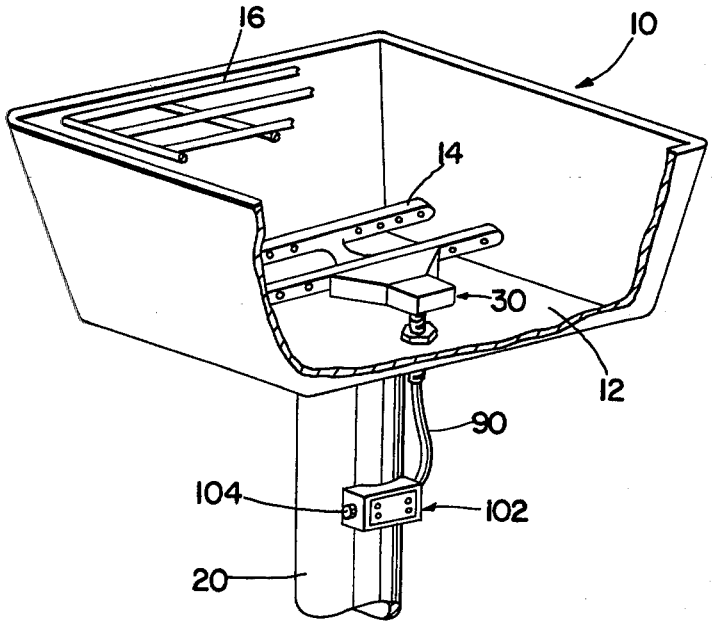
FIG. 1 is a partial perspective illustration of a gas grill having the improved igniter of the present application mounted therein, and with portions cut-away for clarity of illustration.

Referring now to the drawing, and particularly FIG. 1, there is shown a gas grill including a dished housing 10 having a generally flat base 12. A gas burner 14 is mounted within the housing 10 adjacent the housing base 12 for heating briquettes which are positioned on a rack supported above the burner 14 by the housing 10 in a known manner. Food to be cooked is positioned on a rack 16 supported on the housing 10 in a known manner above the briquettes.

A vertical post 20 mounted on the ground or on a portable cart supports the housing 10 and the burner 14. A spark igniter 30 is mounted on the housing base 12 adjacent the burner 14. Flow of gas to the burner 14 is controlled in a known manner by operating a manual valve. When the gas valve is turned on, the igniter 30 is operated for producing a spark which ignites the gas.

Figure 2:
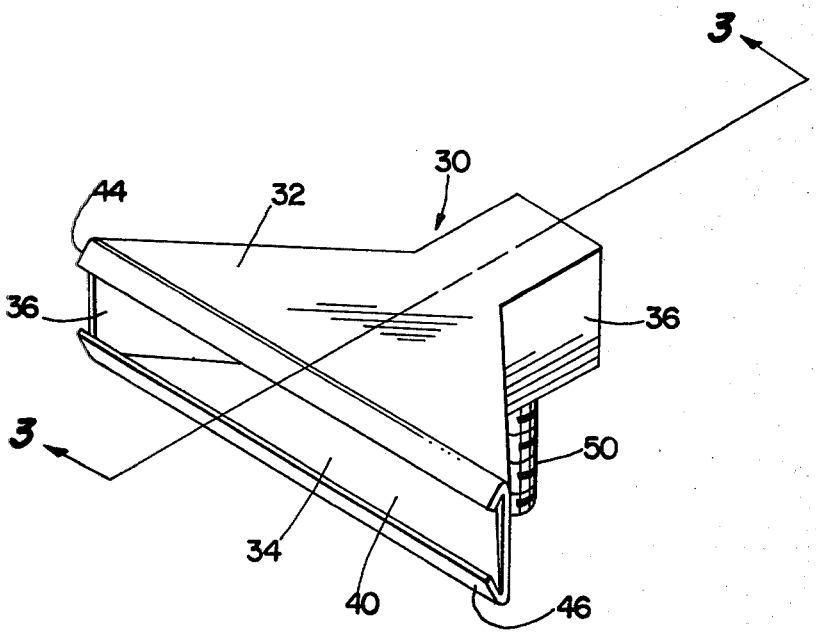
FIG. 2 is a perspective illustration of one type of gas collector with which the improvements of the present application may be used.
Figure 3:
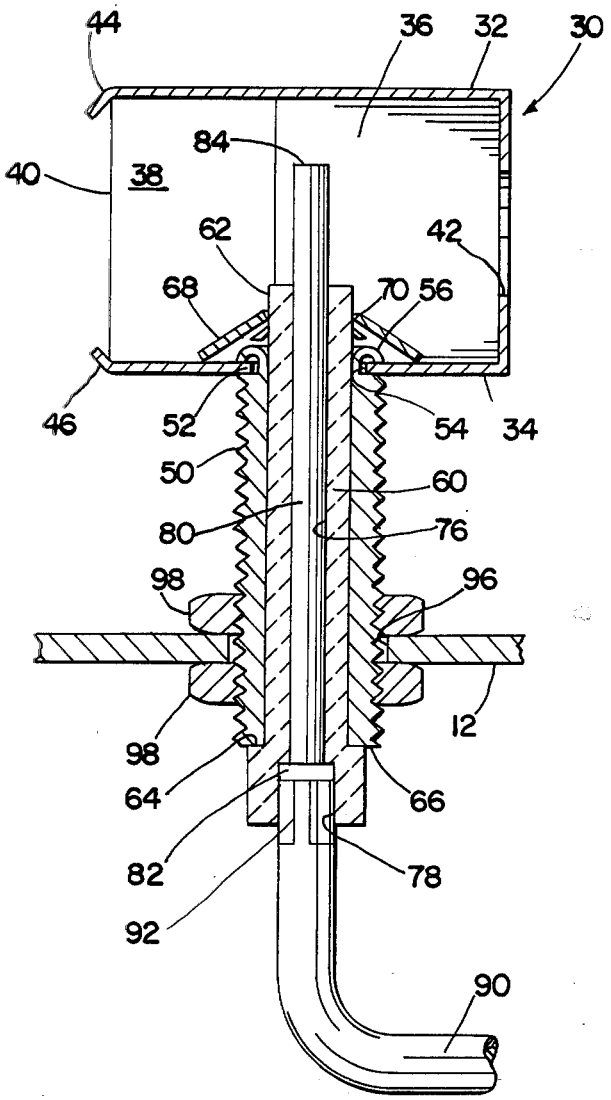
FIG. 3 is a cross-sectional elevational view taken generally on line 3—3 of FIG. 2, and showing the gas collector mounted to a housing base of a gas grill.

As shown in FIGS. 2 and 3, the igniter 30 is in the form of a sheet metal gas collector having a top wall 32, a bottom wall 34 and opposite side walls 36. The spaced top, bottom and side walls 32, 34 and 36 define a gas collector chamber 38 having a large front inlet opening 40 positioned adjacent the gas ports of the burner 14 for receiving gas and allowing same to flow into the chamber 38. The gas collector 30 is shown in FIG. 2 as decreasing in cross-sectional size from the gas inlet opening 40 toward the rear end thereof, and a smaller rear opening 42 is provided for allowing flow of gas completely through the chamber 38. This arrangement aids in providing laminar flow of a combustible mixture of gas and air through the chamber 38 and provides enhanced ignition when a spark is generated.

The collector 30 may be formed in two parts, with the side walls 36 being bent downwardly from, and integral with, the top wall 32. The bottom edges of the opposite side walls 36 may be stake welded or otherwise suitably secured to the bottom wall 34. Integral lips 44 and 46 on the top wall and the bottom wall 34 extend inwardly toward one another along the inlet opening 40 to enhance collection of gas within the chamber 38. It will be recognized that gas collectors of many other designs and shapes may be used with the improvements of the present invention. The gas collector specifically shown and described is merely illustrative of one type of collector in which the prinicples of the present invention may be employed.

Adjustable mounting means for adjustably mounting the collector 30 to the base 12 includes an elongated tube 50 in the form of an externally threaded pipe. The external threads are machined away or otherwise removed over a short length of the tube 50 adjacent one end thereof to provide an outwardly extending tube shoulder 52. The shoulder 52 is spaced along the tube 50 from a terminal end of the tube 50 which is positioned within the chamber 38. A hole 54 is provided in the gas collector bottom wall 34 and the end portion 56 of the tube 50 having the threads removed therefrom is closely received through the hole 54 until the shoulder 52 bears against the outer surface of the collector bottom wall 34. The tube end portion 56 is swaged over into engagement with the inner surface of the collector bottom wall 34 opposite from the tube shoulder 52. The tube 50 may be secured to the bottom wall 34 in the manner described before complete assembly of the collector 30 by staking or otherwise securing the bottom edges of the sidewalls 36 to the bottom wall 34.

A sleeve 60 of ceramic or other suitable high temperature resistant electrical insulating material is closely received through the tube 50. One end portion 62 of the sleeve 60 extends through the hole 54 in the collector bottom wall 34 into the gas collector chamber 38. Adjacent the opposite end of the sleeve 60 from the end portion 62, an outwardly extending circumferential sleeve shoulder 64 is provided for bearing against the free end 66 of the tube 50.

Fastening means for fastening the sleeve 60 within the tube 50 may be many forms. In one arrangement, the fastening means comprises a frustoconical spring grip fastener 68 having a centrally located opening surrounded by a plurality of circumferentially-spaced spring fingers 70. The central opening is of a smaller diameter than the external diameter of the sleeve end portion 62 so that the spring fingers 70 tightly grip the sleeve end portion 62. The outer edge of the spring grip fastener 68 bears against the inner surface of the collector bottom wall 34 to firmly hold the sleeve shoulder 64 in engagement with the tube free end 66.

Figure 3A:
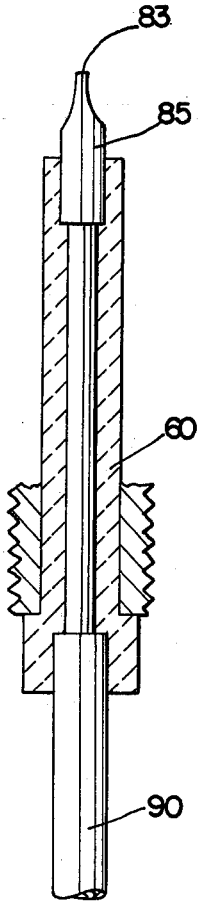
FIG. 3*a* is a cross-sectional elevational view of a modified electrode assembly.

The sleeve 60 has a central hole 76 therethrough and a larger counterbore 78 is coincidental therewith adjacent the end portion of the sleeve 60 having the shoulder 64 thereon. An elongated metal electrode 80 extends through the hold 76 until a flattened or enlarged electrode end 82 abuts the shoulder provided at the intersection between the hole 76 and the bore 78. With the electrode 80 being of a predetermined length, this accurately locates electrode tip 84 at a predetermined distance from the ceramic sleeve shoulder 64. The gap between the electrode tip 84 and the inner surface of the collector top wall 32 defines a spark gap across which a spark jumps when an electrical potential is applied to the electrode 80. In effect, this provides sparking means within the gas collector chamber 38 for igniting a combustible mixture therein. Alternative to the flat end construction 84 of electrode 80 shown in FIG. 3, the tip 83 narrows toward the longitudinal end and is composed of a conductor in sleeve-like form 85 crimped on electrode 84 as shown in FIG. 3*a*.

A wire 90 suitably sheathed in high temperature resistant electrical insulating material is attached to the electrode end 82 in electrically conductive relationship therewith. The electrode 80 may be held within the sleeve 60 in any suitable manner, and a longitudinally split spring metal sleeve 92 is shown in gripping relationship with the bore 78 and with the sheath on the wire 90. Obviously, many other arrangements may be used for securing the electrode in the sleeve 60.

The ceramic sleeve 60, the elecrode 80 and the wire 90 are assembled separate from the collector 30 and the tube 50. The assembly is then attached to the collector 30 and the tube 50 simply by inserting the sleeve 60 up through the tube 50 until the sleeve shoulder 64 bears against the tube free end 66. The spring grip fastener 68 is then pushed over the upper end portion 62 of the sleeve 60. This automatically locates the electrode tip 84 in a predetermined desired location relative to the top wall 32 for defining a spark gap therewith. Obviously, it is possible to use other fastening means for fastening the sleeve 60 in position, and it is also possible to provide other arrangements for securing the tube 50 to the collector 30. The swaged tube end portion 56 is preferably staked to the bottom wall 34 for preventing relative longitudinal and rotational movement between the collector 30 and the tube 50. The hole 54 may also be non-circular to prevent relative roration between the collector 30 and the tube 50.

The housing base 12 has a mounting hole 96 therethrough for closely receiving the tube 50. A pair of nuts 98 are threaded on the tube 50 on opposite sides of the housing base 12 for clamping onto the base 12 and securely holding the tube 50 thereto. Obviously, the wire 90 and the lower portion of the tube 50 are extended through the mounting hole 96 before the lower nut is threaded onto the tube 50. Selective rotation of the nuts 98 allows vertical adjustment of the collector 30 for locating the collector inlet 40 at a proper location relative to the gas ports of the burner.

The end of the wire 90 opposite from the electrode 80 is connected to an electro-mechanical transducer within housing 102 FIG. 1 and having a manually operable pushbutton 104 for stressing the transducer and raising the electrical potential of the electrode 80 so that a spark will jump across the electrode tip 84 and the collector top wall 32. The electro-mechanical transducer may be of any suitable type, including a piezoelectric voltage source such as those disclosed in U.S. Pat. Nos. 3,449,637 issued June 10, 1969, to Suzuki, and 3,469,119 issued Sept. 23, 1969, to Parkinson.

While there has been described what is at present considered to be the preferred embodiment of this invention, it will be obvious to those skilled in the art that various changes and modification may be made therein without departing from the invention, and it is aimed, therefore, in the appended claims to cover all such changes and modifications as fall within the true spirit and scope of the invention.

I claim:

1. A spark igniter for gas burners comprising: a gas collector formed of metal and having spaced top, bottom and side walls defining a collector chamber, a gas inlet to said chamber, a collector mounting tube having one end portion secured to said bottom wall against relative longitudinal and rotational movement between said gas collector and said mounting tube, said tube having a free end opposite from said one end portion, a hole in said bottom wall aligned with said tube, a ceramic sleeve having an electrode mounted therein and including an electrode tip extending therefrom, said sleeve being received in said tube with said electrode extending through said hole and with said electrode tip positioned in said collector chamber, said sleeve having an outwardly extending sleeve shoulder generally opposite from said electrode tip, said sleeve shoulder bearing against said free end of said tube for locating said electrode tip a predetermined distance from said top wall, and fastener means securing said sleeve in said tube.

2. The igniter of claim 1 wherein said one end portion of said tube extends through said hole in said bottom wall, said tube having an outwardly extending tube shoulder bearing against the outer surface of said bottom wall, and said one end portion being swaged over against the inner surface of said bottom wall opposite from said tube shoulder.

3. The igniter of claim 2 wherein said tube comprises an externally threaded pipe having the threads removed thereform along said one end portion to form said tube shoulder.

4. A spark igniter for gas grills of the type including a gas burner connected with a gas supply and being positioned adjacent a base of a dished housing, said igniter including a gas collector having an inlet for receiving gas from the burner, sparking means within said collector for igniting gas within said collector, said collector including adjustable mounting means for adjustably mounting said collector to the base of the housing for vertical adjustment to align said inlet with the burner, said mounting means including an elongated tube and said sparking means including an electrode extending into said collector through said tube.

5. A spark igniter for gas grills of the type including a gas burner connected with a gas supply and being positioned adjacent a base of a dished housing, said igniter including a gas collector having an inlet for receiving gas from the burner, sparking means within said collector for igniting gas within said collector, said collector including adjustable mounting means for adjustably mounting said collector to the base of the housing for vertical adjustment to align said inlet with the burner, said mounting means including an elongated tube, said sparking means including a sleeve of high temperature resistant electrical insulating material and an electrode mounted in said sleeve and having an electrode tip extending therefrom, said sleeve being received in said tube with said electrode tip positioned in said collector, and fastener means for securing said sleeve within said tube.

6. The igniter of claim 5 wherein said sleeve has an external sleeve shoulder bearing against the outer end of said tube for positively locating said electrode tip in a desired position within said collector.

7. The igniter of claim 6 wherein said sleeve extends completely through said tube and has an upper sleeve end portion positioned in said collector, and said fastener means for securing said sleeve within said tube comprising a spring grip fastener received on said upper sleeve end portion and bearing against an inner surface of said collector and holding said sleeve shoulder against said outer end of said tube.

8. A spark igniter for gas grills of the type including a gas burner connected with a gas supply and being positioned adjacent a base of a dished housing, said igniter including a gas collector having an inlet for receiving gas from the burner, sparking means within said collector for igniting gas within said collector, said collector including adjustable mounting means for adjustably mounting said collector to the base of the housing for vertical adjustment to align said inlet with the burner, said adjustable mounting means including an externally threaded pipe having one end portion secured to said collector against relative longitudinal and rotational movement, said sparking means including a ceramic sleeve and an electrode mounted in said sleeve and having an electrode tip extending therefrom, said sleeve having an outwardly extending sleeve shoulder and said pipe having a free end opposite from said one end portion, said sleeve being received in said pipe with said sleeve shoulder bearing against said free end of said pipe and with said electrode tip positioned within said collector, said sleeve having a sleeve mounting end portion opposite from said sleeve shoulder and being received in said collector, and fastener means on said sleeve mounting end portion within said collector for holding said sleeve shoulder against said free end of said pipe.

9. A spark igniter for gas burners comprising: a gas collector formed of metal and having spaced top, bottom and side walls defining a collector chamber, a gas inlet to said chamber, a collector mounting tube having one end portion secured to said bottom wall against relative longitudinal and rotational movement, said tube having a free end opposite from said one end porton, a hole in said bottom wall aligned with said tube, a ceramic sleeve having an electrode mounted therein said including an electrode tip extending therefrom, said sleeve being received in said tube with said electrode tip positioned in said collector chamber, said sleeve having an outwardly extending sleeve shoulder generally opposite from said electrode tip, said sleeve shoulder bearing against said free end of said tube for locating said electrode tip a predetermined distance from said top wall, said sleeve having a sleeve end portion extending through said hole in said bottom wall into said collector chamber, and a spring grip fastener griping said sleeve end portion and bearing against the inner surface of said bottom wall to hold said sleeve shoulder against said free end of said tube.

* * * * *